US009833872B2

(12) United States Patent
Rubens

(10) Patent No.: US 9,833,872 B2
(45) Date of Patent: Dec. 5, 2017

(54) ADJUSTABLE CONTOUR SANDER ATTACHMENT FOR A POWER TOOL

(71) Applicants: Robert Bosch Tool Corporation, Broadview, IL (US); Robert Bosch GmbH, Stuttgart (DE)

(72) Inventor: Jeremy Rubens, Palatine, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 30 days.

(21) Appl. No.: 14/982,295

(22) Filed: Dec. 29, 2015

(65) Prior Publication Data

US 2016/0184957 A1 Jun. 30, 2016

Related U.S. Application Data

(60) Provisional application No. 62/097,731, filed on Dec. 30, 2014.

(51) Int. Cl.
*B24B 23/04* (2006.01)

(52) U.S. Cl.
CPC ..... *B24B 23/04* (2013.01)

(58) Field of Classification Search
CPC ..... B24B 23/04
USPC ..... 451/356, 357, 524, 523, 495, 442, 28
See application file for complete search history.

(56) References Cited

U.S. PATENT DOCUMENTS 470,794 A * 3/1892 Shempp ..... B24D 15/04 451/495
1,062,214 A * 5/1913 Bergman ..... B24D 15/04 451/495
1,570,177 A * 1/1926 Pointer ..... B24D 15/00 15/231

* cited by examiner

*Primary Examiner* — Robert Rose
(74) *Attorney, Agent, or Firm* — Maginot Moore & Beck LLP

(57) ABSTRACT

A contour sanding accessory is provided for a power tool having a drive element capable of reciprocating or oscillatory motion. The accessory includes a mounting plate including a mounting portion configured for engagement to the drive element of the power tool, and a support portion connected to the mounting plate, the support portion defining a support surface. The accessory is further provided with two or more planar members sized to be stacked on the support surface and clamped onto the support portion of the mounting plate by a clamp assembly. The planar members are configured for relative sliding in a longitudinal direction so that the working edges of the planar members conform to the contour of the surface to be sanded. The clamp assembly is configured in a released position to allow the longitudinal movement and in a clamped position to clamp the accessory together for use in sanding the contoured surface.

15 Claims, 5 Drawing Sheets

ADJUSTABLE CONTOUR SANDER ATTACHMENT FOR A POWER TOOL

PRIORITY CLAIM

This application is a utility filing from and claims priority to co-pending U.S. Provisional Application No. 62/097,731, filed on Dec. 30, 2014, the entire disclosure of which is incorporated herein by reference.

TECHNICAL FIELD

The disclosure relates to sanding devices and more particularly to an adjustable contour sanding attachment for a power tool.

BACKGROUND

There are a number sanding devices available for a user to sand or work a contoured surface. One simple sanding device that can be used to sand a contoured surface includes a body with at least one deformable member that supports a segment of sandpaper. When the user presses this sanding device onto the contoured surface, the deformable member deforms to approximate the shape of the contoured surface as the device is moved over the surface. One problem with manual contour sanders that use a deformable member is that it is difficult to ensure even pressure across the sanding surface because the contoured surface will compress different portions of the deformable member more than other portions. Another problem with manual contour sanders generally is that the user may become fatigued if the contoured surface extends for a considerable length. For example, the profile in a wall molding in a room of a typical residential home may have a height that extends for only a few inches, but the length of the profile along sequential moldings on multiple walls in the room may extend for fifty feet or more.

Many types of power tools have been adapted to facilitate sanding of different types of surfaces. For example, belt sanders and orbital sanders are common power sanding devices used in various industries for sanding surfaces. An oscillating power tool is another type of power tool that is well adapted for sanding. An oscillating power tool generally includes a motor and a driving shaft driven by the motor. The driving shaft moves in an oscillatory manner. A working tool with a sanding edge can be attached to the driving shaft and can move with the driving shaft to sand a workpiece surface. Oscillating power tools work well for sanding since they are not too aggressive and are generally able to sand small details in the surface due to the small stroke of the working tool.

Some existing oscillating power tools offer multiple tool attachments for sanding contoured surfaces. These tool attachments generally have generic shape profiles preformed into the respective working edges of the tool attachments to facilitate sanding the contoured surface. In some cases, the tool attachments are used directly on the contoured surface. In other cases, the tool attachment supports a segment of sandpaper that moved over the contoured surface. In order to sand an existing contour in a surface, the user selects the tool attachment with a shape profile that most closely approximates the shape of the surface and then sands the surface with the selected tool attachment secured to the oscillating tool. One issue with selecting a tool attachment with a generic shape profile is that the tool attachment rarely matches the actual profile of the surface.

When the user sands the surface with a tool attachment profile that does not match the surface contour, the sanding damages the surface and/or multiple passes are required to achieve the desired profile in the surface. Another issue with the sander attachments of existing oscillating power tools is that a significant number of individual attachments are needed to cover the wide variety of shapes and sizes of surface contours.

What is needed, therefore, is an accessory for a power tool that enables the user to quickly adjust a profile of the accessory to match the contour of a surface to be worked.

SUMMARY

An adjustable contour sander is provided for a power tool having a drive element capable of reciprocating or oscillatory motion. The accessory includes a mounting plate including a mounting portion configured for engagement to the drive element of the power tool, and a support portion connected to the mounting plate, the support portion defining a support surface. The accessory is further provided with two or more planar members sized to be stacked on the support surface and clamped onto the support portion of the mounting plate by a clamp assembly. The planar members are configured for relative sliding in a longitudinal direction so that the working edges of the planar members conform to the contour of the surface to be sanded. The clamp assembly is configured in a released position to allow the longitudinal movement and in a clamped position to clamp the accessory together for use in sanding the contoured surface.

In one aspect, the mounting portion is planar and defines a first plane, and the support portion is planar and defines a second plane offset from the first plane. The support portion may include opposite upturned tabs defining a lateral space therebetween that is sized for a close running fit with the planar members stacked therebetween.

In another feature, each of the two or more planar members defines an elongated opening aligned with the longitudinal direction when the planar members are stacked on the support portion. The clamp assembly includes a clamp member configured to extend through the elongated opening of each of the two or more planar members and is engageable to the support

DETAILED DESCRIPTION

Figure 1:
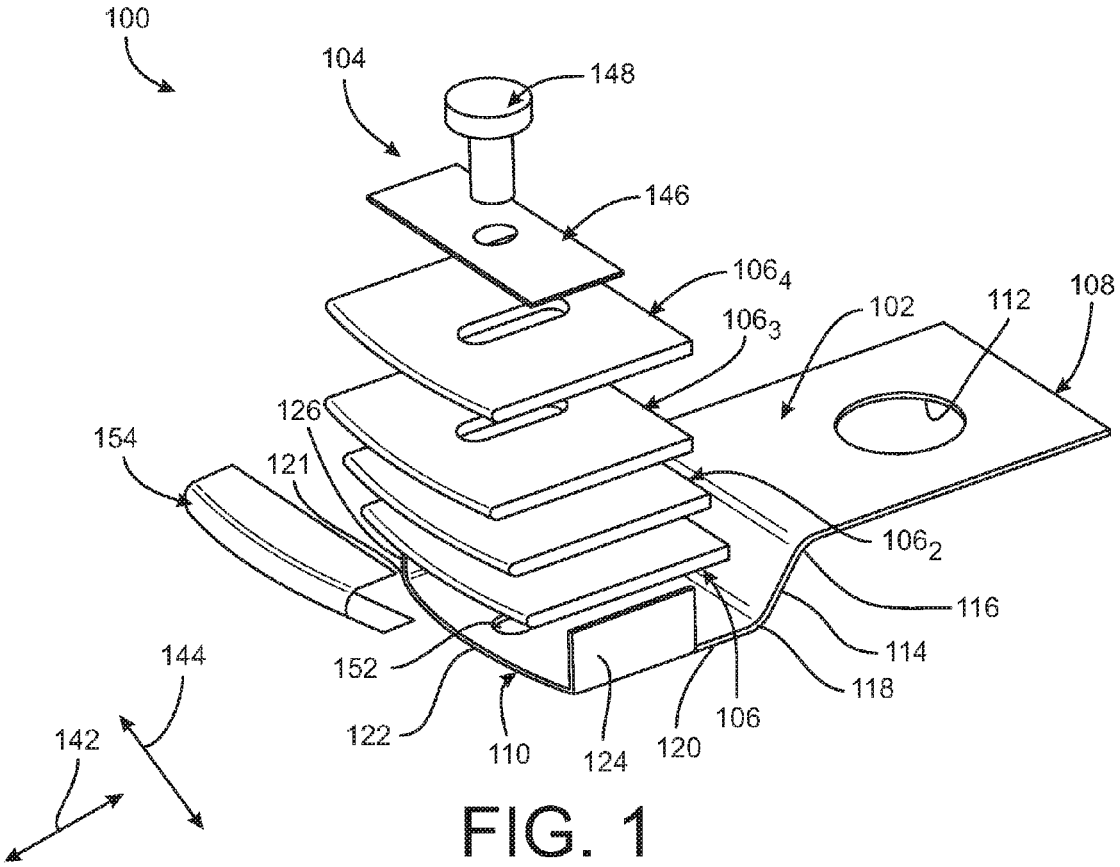
FIG. 1 shows a side perspective exploded view of an adjustable contour sander attachment for a power tool.

For the purposes of promoting an understanding of the principles of the disclosure, reference will now be made to the embodiments illustrated in the drawings and described in the following written specification. It is understood that no limitation to the scope of the disclosure is thereby intended. It is further understood that the disclosure includes any alterations and modifications to the illustrated embodiments and includes further applications of the principles of the disclosure as would normally occur to one of ordinary skill in the art to which this disclosure pertains.

Embodiments of the disclosure are directed to an accessory tool for use with hand held power tools of the type which have an output shaft that moves in an oscillating manner, such as through a small arc of approximately 2-7° at a high frequency that can extend from less than 10000 oscillations per minute to more than 20000 oscillations per minute. Exemplary tools are marketed by Robert Bosch LLC under the Dremel® brand as the Multi-Max™ oscillating tool and such a tool is shown in the drawings of the disclosure. It should be understood that the accessory tool, while particularly designed and configured for use with this type of tool, can be configured for use with other types and brands of power tools, if desired.

Figure 5:
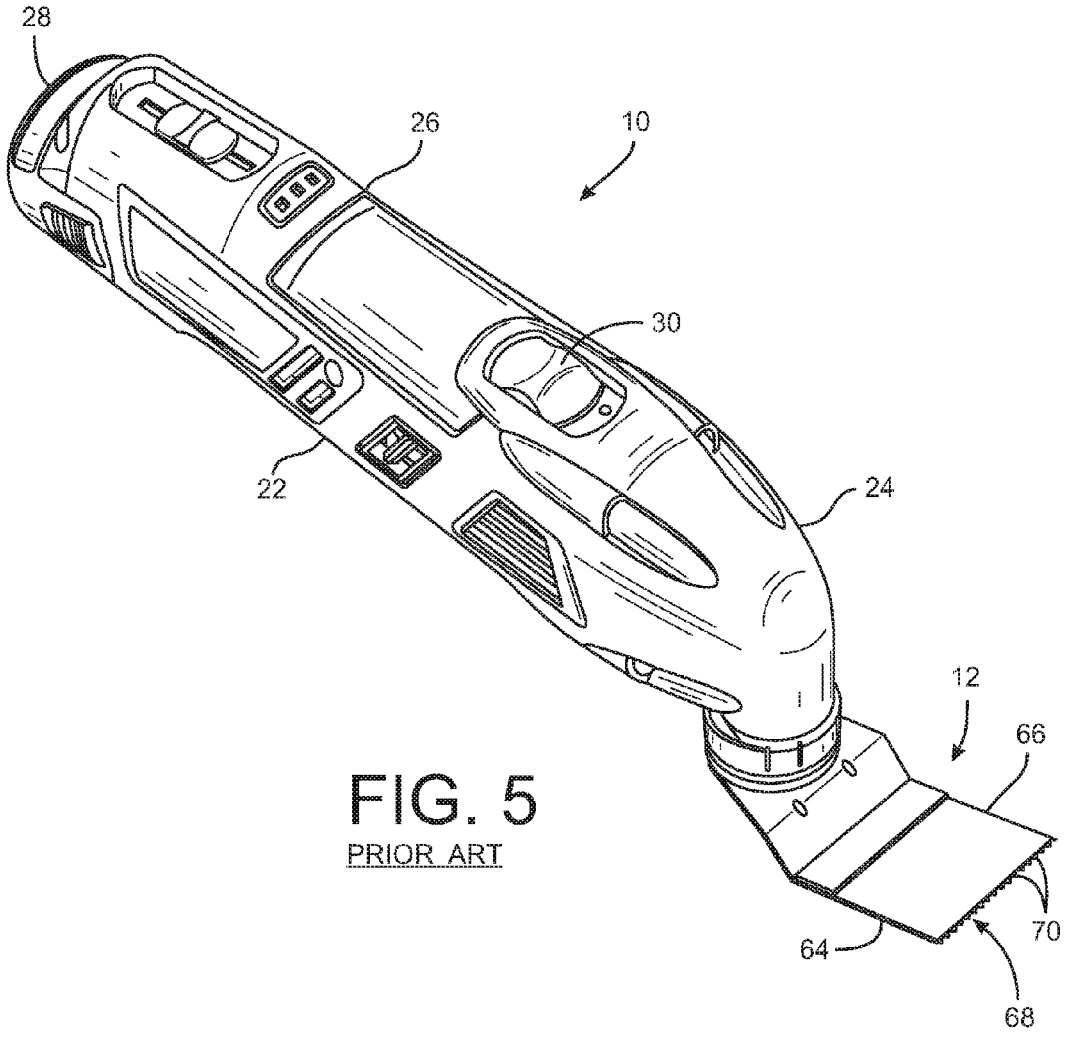
FIG. 5 PRIOR ART
FIG. 5 depicts a perspective view of a prior art oscillating tool including an accessory tool.
Figure 6:
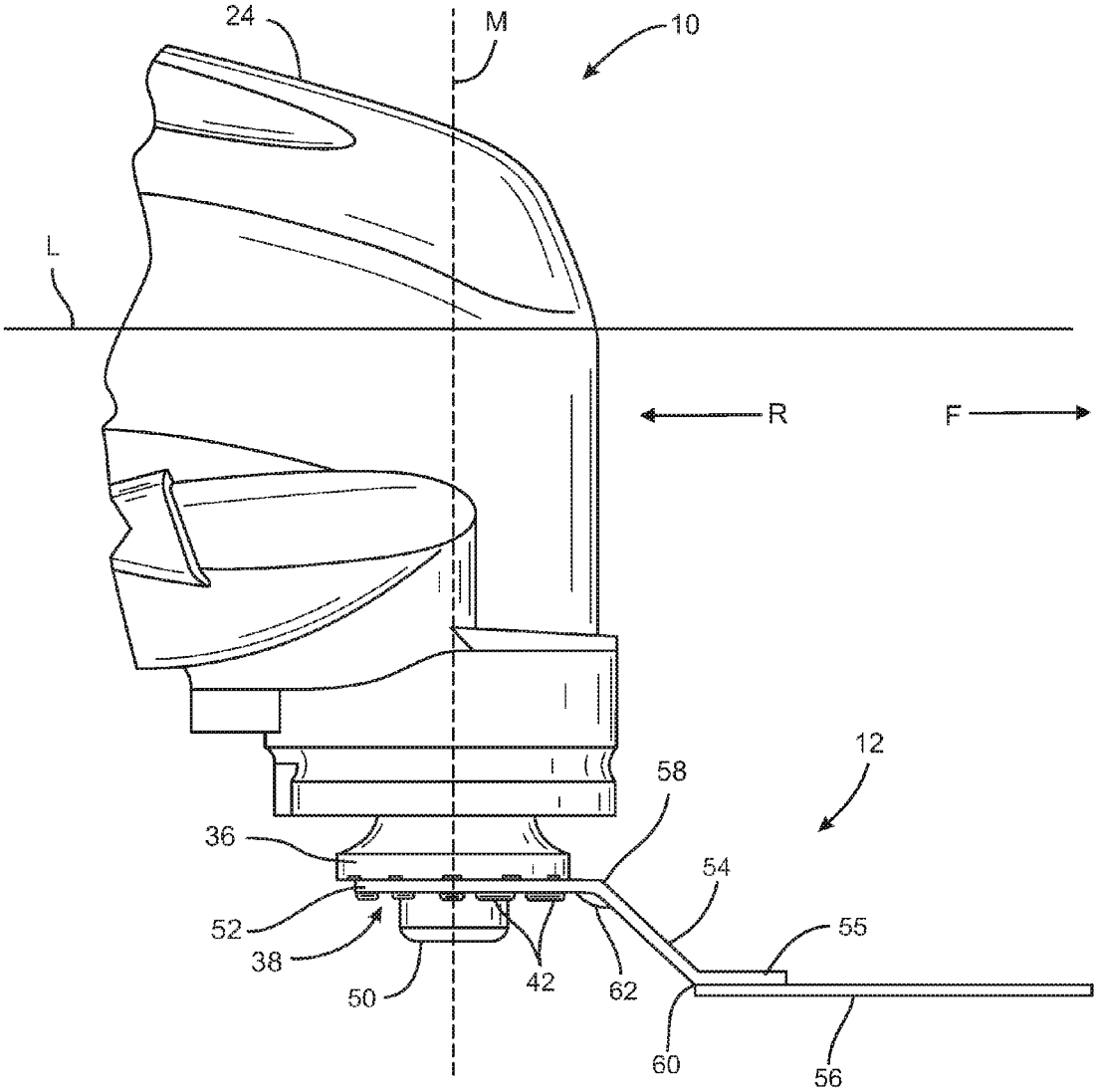
FIG. 6 PRIOR ART
FIG. 6 shows a partial view of the prior art oscillating tool and accessory tool of FIG. 5 showing the nose portion of the oscillating tool.

FIG. 5 and FIG. 6 depict an oscillating power tool 10 having elements pertinent to the disclosure. The oscillating tool 10 is configured to drive at least one accessory tool 12 to operate on a variety of materials including, but not limited to, wood, laminate, steel, aluminum, copper, vinyl, carpet, caulk, adhesive, stone, cement, and grout. The oscillating tool 10 includes a generally cylindrically shaped housing 22 constructed of a rigid material such as plastic, metal, or composite materials such as a fiber reinforced polymer. The housing 22 includes a nose portion 24 and a handle portion 26. The handle portion 26 encloses a motor (not shown). In one embodiment, the motor includes an electric motor configured to receive power from a rechargeable battery 28 connected at the base of the handle portion 26. In other embodiments, electric power for the motor is received from an AC outlet via a power cord (not shown). As an alternative to electric power, the oscillating power tool 10 is pneumatically or hydraulically powered. Power to the motor is controlled by a power switch 30 provided on the handle portion 26 of the housing 22.

Referring to FIG. 6, the housing 22 of the oscillating tool 10 defines a longitudinal axis L. An oscillating drive member (not shown) extends generally perpendicularly with respect to the longitudinal axis L. The motor can be configured to oscillate the drive member about an axis M at high frequencies, e.g., 5,000 to 25,000 oscillations per minute, with a small oscillating angle, typically in a range of between 0.5° and 7°. The drive member supports an accessory tool holder 36 exterior to the housing 24. The tool holder 36 is configured to releasably secure various accessory tools to the drive member, such as the accessory tool 12. As the tool holder 36 is oscillated by the drive member, the accessory tool 12 is driven to oscillate about the axis M.

To enable a secure connection between the tool holder 36 of the oscillating tool 10 and accessory tools for use with the oscillating tool, the tool holder 36 and associated accessory tools are provided with complementary drive structures 38, 40 (FIG. 7) that mate to secure the accessory tool 12 to the tool holder 36. In the embodiments described herein, the tool holder 36 includes a tool drive structure 38 that has a plurality of protrusions 42 arranged in a circular pattern about a central bore 44.

Figure 7:
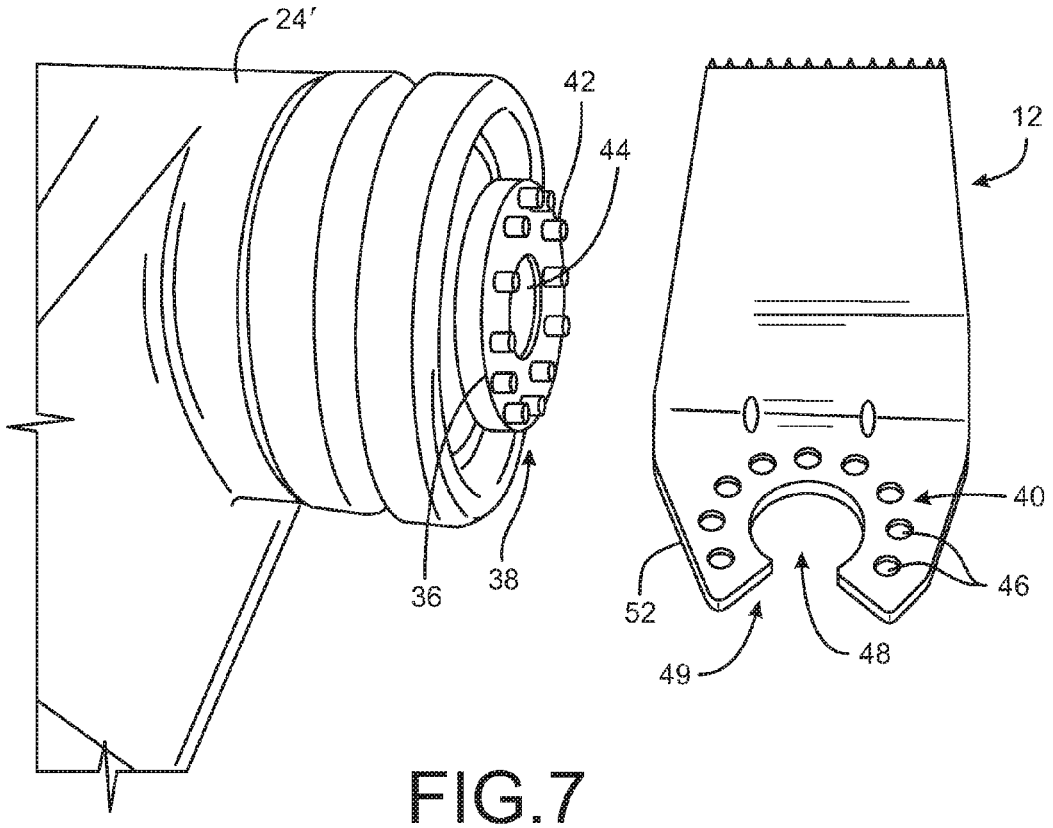
FIG.7 PRIOR ART
FIG. 7 depicts a bottom perspective view of the oscillating tool of FIG. 5 illustrating a mounting interface between oscillating tool and the accessory tool.
Figure 2:
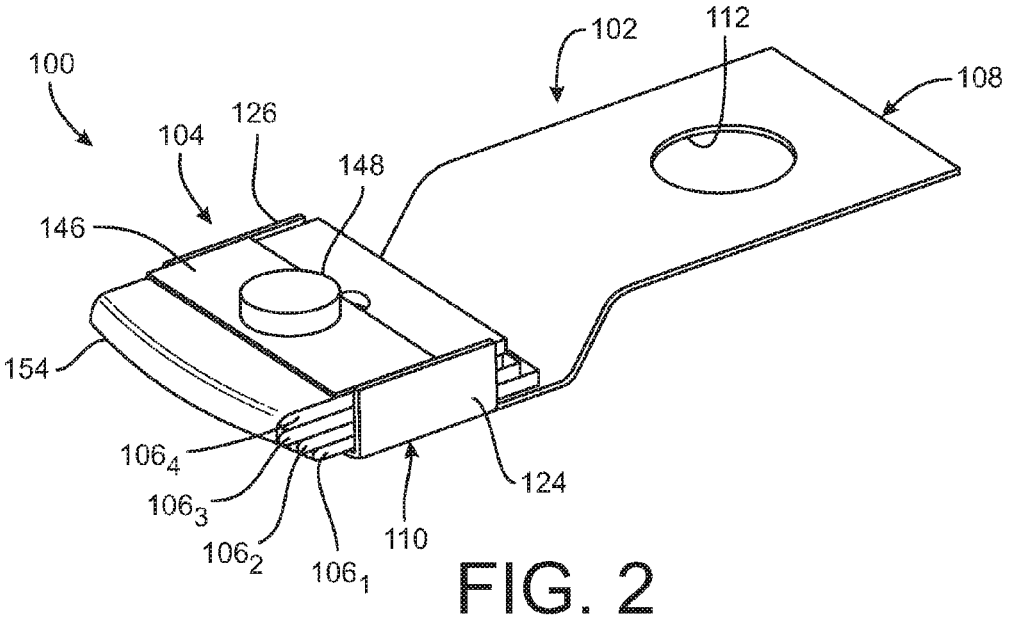
FIG. 2 shows a side perspective view of the adjustable contour sander attachment of FIG. 1.

Accessory tools for use with the power tool 10, such as the accessory tool 12, include an accessory drive structure 40 (FIG. 7) that is configured to mate or interlock with the tool drive structure 38 of the tool holder 36. As depicted in FIG. 7, the accessory drive structure 40 of the accessory tool 12 includes a plurality of openings or recesses 46 and a central opening 48 that are sized, shaped, and positioned complementary to the protrusions 42 and central bore 44, respectively, of the tool drive structure 38. When the accessory tool 12 is placed onto the tool holder 36, the protruding features 42 of the tool drive structure 38 are received in the corresponding openings and/or recesses 46 defined in the accessory drive structure 40.

A clamping member 50 (FIG. 6), such as a clamping screw, is used to press the accessory drive structure 40 of the accessory tool 12 into interlocking engagement with the tool drive structure 38 thereby securing the accessory tool 12 to the tool holder 36. The interlocked drive structures 38, 40 enable the oscillating movement of the tool holder 36 to be imparted to the accessory tool 12. As depicted in FIG. 7, a mounting portion 52 defines a slot 49 that extends from a central opening 48 through the outer periphery of the mounting portion 52. The slot 49 enables the mounting portion 52 to be installed and removed from the tool holder 36 without having to completely remove the clamping screw 50.

Figure 3:
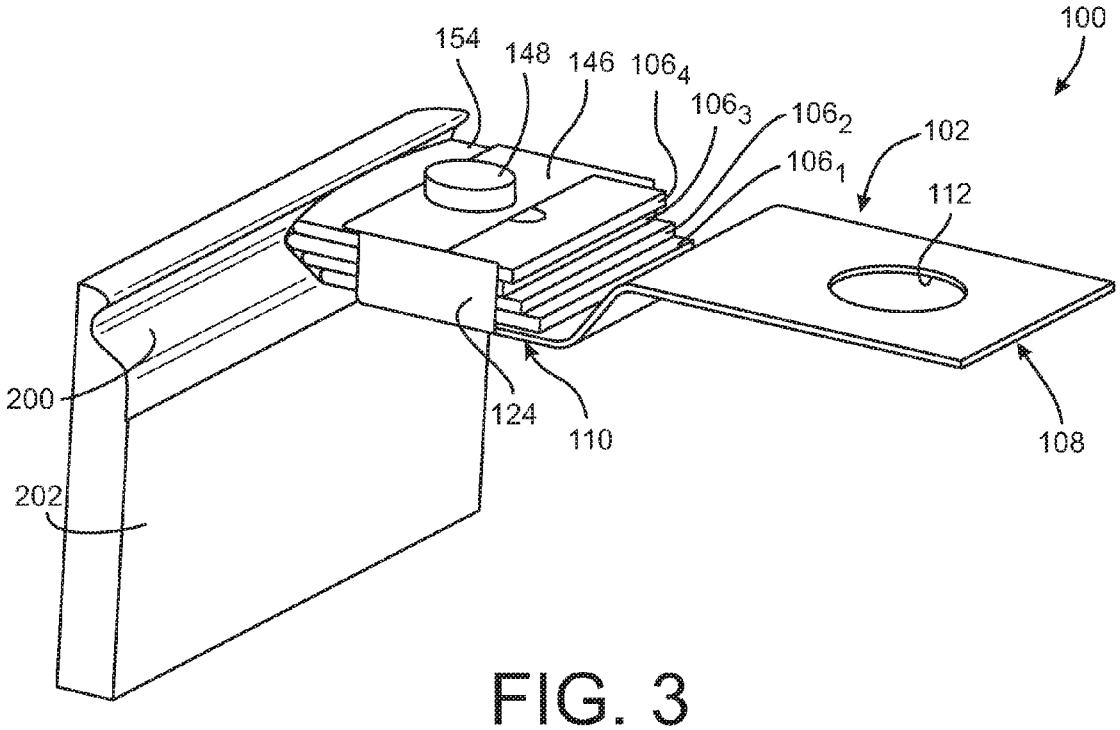
FIG. 3 depicts a side perspective view of the adjustable contour sander attachment of FIG. 1 engaging a contoured surface.

FIGS. 1-4 illustrate an accessory 100 for a power tool, such as the oscillating power tool 10 (FIG. 5 and FIG. 6) that is used to sand a contour 200 in a surface 202 (FIG. 3). The accessory tool 100 includes a mounting plate 102, a clamp assembly 104, and a plurality of planar members $\mathbf{106}_x$. The mounting plate 102 in the embodiment shown includes a generally planar body including a mounting portion 108 that attaches to the power tool 10 and a supporting portion 110 that supports and partially encloses the planar members $\mathbf{106}_x$. The planar body is formed by stamping and bending one or more metal plates made of hard metal materials, such as carbon and alloy steel or stainless steel. In the embodiment of FIGS. 1-4, the mounting plate 102 can have a one-piece construction in which the mounting portion 108 and the supporting portion 110 are integrally formed by stamping and bending a single metal plate. Alternatively, the mounting plate 102 in other embodiments has a two-piece configuration in which the mounting portion 108 is formed from a first plate and the supporting portion 110 is provided as a second plate that is secured to the first plate.

The mounting portion 108 has a generally flat disc-like shape that defines a central opening 112. Although not shown in the embodiment of FIGS. 1-4, the mounting portion 108 includes a drive structure that mates with a complimentary drive structure on the tool holder 36 to secure the mounting plate 102 to the oscillating tool 10. In some embodiments, the mounting portion 108 defines an accessory drive structure (similar to the drive structure 40 in FIG. 7) that includes a slot (similar to slot 49 in FIG. 7) and surrounding openings (similar to openings 46 in FIG. 7) for attachment to the power tool 10. The accessory drive structure is secured to the tool holder 36 with the mounting portion 108 and the supporting portion 110 arranged substantially perpendicular to the axis M of the drive member as depicted in FIG. 6. The mounting portion 108 thus oscillates substantially in a first plane, or oscillation plane, that is perpendicular to the axis M of the drive member.

The mounting plate 102 includes an interface portion 114 that is interposed between the mounting portion 108 and the supporting portion 110. The interface portion 114 extends generally forwardly and downwardly from the mounting portion 108 to the supporting portion 110 in order to offset the supporting portion 110 from the mounting portion 108 and provide clearance for the tool holder 36 and the clamping screw 50 (FIG. 6) during use near a floor surface. The interface portion 114 includes a first angled, or bent, portion 116 located between the mounting portion 108 and interface portion 114, and a second angled, or bent, portion 118 that is located proximate the supporting portion 110. In the embodiment of FIGS. 1-4, the interface portion 114 transitions into the supporting portion 110 at the second bent portion 118. The mounting portion 108 of the mounting plate thus defines a first plane and the support portion 110 defines a second plane that is offset from the first plane by the interface portion 114.

Although not shown in the embodiment of FIGS. 1-4, gussets may be provided in one or more of the first bent portion 116 and the second bent portion 118 of the interface portion 114 for strengthening the bends against further bending. In one embodiment, the gussets comprise ribs formed by pressing the bends from the outside to form protrusions in the inside corners of the bends (similar to gusset 62 in FIG. 6).

The supporting portion 110 of the mounting plate 102 is in the form of a plate that extends from the interface portion 114 in a forward direction generally parallel to the oscillation plane defined by the mounting portion 108. The supporting portion 110 includes a first lateral edge portion 120, a second lateral edge portion 121, and a forward edge portion 122. The first lateral edge portion 120 and the second lateral edge portion 121 are arranged generally parallel to each other on opposing sides of the supporting portion 110. As best shown in FIG. 1, the forward edge portion 122 can be arcuate, exhibiting a curvature that forms a slight radius from an origin located at the center of the central opening 112.

The supporting portion 110 also includes a first lateral tab 124 and a second lateral tab 126 that are arranged generally parallel to each other and upturned on opposing sides of the supporting portion 100 in order to restrain the planar members $\mathbf{106}_x$ in a lateral direction (arrow 144 in FIG. 1) on the mounting plate 102 while permitting relative sliding in the longitudinal direction 142. The first lateral tab 124 extends upwardly from the supporting portion 110 along a portion of the first lateral edge 120 and the second lateral tab 126 extends upwardly from the supporting portion 110 along a portion of the second lateral edge 121. In the embodiment of FIGS. 1-4, the first lateral tab 124 and the second lateral tab 126 extend approximately perpendicularly from the supporting portion 110. In other embodiments, one or more of the first lateral tab 124 and the second lateral tab 126 can extend from the supporting surface at an angle greater or lesser than 90 degrees. The tabs 124, 126 may define a width therebetween that is sized for a close running fit with side edges 130, 134 of the planar members that allows the planar members to slide freely in the longitudinal direction while restraining lateral movement or pivoting of the planar members relative to each other and to the mounting plate.

Figure 1A:
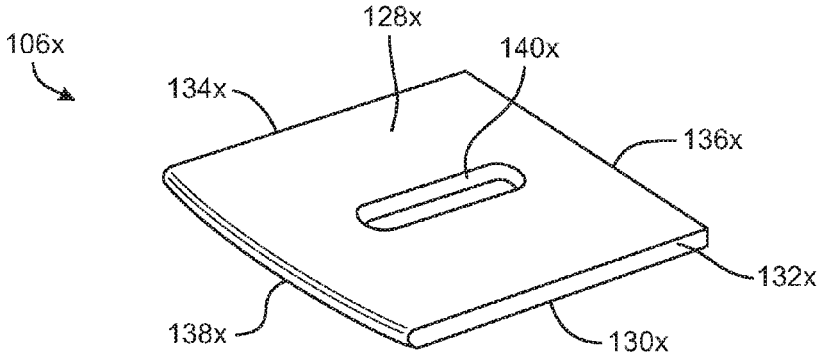
FIG. 1A shows an enlarged view of a planar member of the adjustable contour sander attachment of FIG. 1.

Referring now to FIG. 1A, an enlarged view of one of the planar members $\mathbf{106}_x$ of FIG. 1 is shown for purposes of describing the structure of each of the planar members $\mathbf{106}_x$. For simplicity, the subscript "$_x$" has been used following the reference numerals denoting the features of the planar members $\mathbf{106}_x$ since the features of each of the planar members in the embodiment shown are generally identical. The planar members $\mathbf{106}_x$ each have an upper surface $\mathbf{128}_x$, a lower surface $\mathbf{130}_x$, a first lateral edge $\mathbf{132}_x$, a second lateral edge $\mathbf{134}_x$, a back edge $\mathbf{136}_x$, and an outer working edge $\mathbf{138}_x$. In the embodiment shown, the lower surface $\mathbf{130}_x$ is opposed to the upper surface $\mathbf{128}_x$, the second lateral edge $\mathbf{134}_x$ is parallel and opposed to the first lateral edge $\mathbf{132}_x$, and the outer working edge $\mathbf{138}_x$ is opposed to the back edge $\mathbf{136}_x$. The working edge 138*x* in some embodiments is parallel to the lateral back edge 136*x*. The working edge 138*x* in other embodiments, such as the embodiment shown in FIGS. 1-4, can be arcuate, exhibiting a curvature that forms a radius from an origin at the center of the central opening 112 when the planar members $\mathbf{106}_x$ are secured in at least one position on the mounting plate 102. Moreover, the working edges $\mathbf{138}_x$ may be rounded along the edge or between the edges and the surfaces of the planar members.

The planar members $\mathbf{106}_x$ in one embodiment have a uniform width between the first $\mathbf{132}_x$ and second $\mathbf{134}_x$ lateral edges so as to enable the first 124 and second 126 lateral tabs of the mounting plate 102 to align the planar members $\mathbf{106}_x$ in the lateral direction 144. The planar members $\mathbf{106}_x$ also each have an elongated slot $\mathbf{140}_x$ opening to the upper $\mathbf{128}_x$ and lower $\mathbf{130}_x$ surfaces and extending generally in a longitudinal direction (arrow 142 in FIG. 1) along the center of the planar member $\mathbf{106}_x$. It can be appreciated that the first and second lateral tabs 124, 126 may be incorporated into the planar members $\mathbf{106}_x$ to contact the lateral edges of adjacent planar members and the lateral edges of the mounting plate 102.

Referring again to FIGS. 1-4, the planar members $\mathbf{106}_x$ are arranged on the supporting portion 110 in a stack of planar members with the respective upper $\mathbf{128}_x$ and lower $\mathbf{130}_x$ surfaces of adjacent planar members $\mathbf{106}_x$ positioned in slidable contact with one another. In the embodiment shown, a first planar member $\mathbf{106}_1$ is arranged adjacent to the supporting portion with the lower surface $\mathbf{130}_1$ of the first planar member $\mathbf{106}_1$ in slidable contact with an upper surface of the supporting portion 110. A second planar member $\mathbf{106}_2$ is arranged adjacent to the first planar member $\mathbf{106}_1$ with the lower surface $\mathbf{130}_2$ of the second planar member $\mathbf{106}_2$ in slidable contact with the upper surface $\mathbf{128}_1$ of the first planar member $\mathbf{106}_1$. A third planar member $\mathbf{106}_3$ is arranged adjacent to the second planar member $\mathbf{106}_2$ with the lower surface $\mathbf{130}_3$ of the third planar member $\mathbf{106}_3$ in slidable contact with the upper surface $\mathbf{128}_2$ of the second planar member $\mathbf{106}_2$. A fourth planar member $\mathbf{106}_4$ is arranged adjacent to the third planar member $\mathbf{106}_3$ with the lower surface $\mathbf{130}_4$ of the fourth planar member $\mathbf{106}_4$ in slidable contact with upper surface $\mathbf{128}_3$ of the third planar member $\mathbf{106}_3$. In other embodiments, the accessory 100 can include a greater or lesser number of stacked planar members $\mathbf{106}_x$ on the mounting plate 102.

The planar members $\mathbf{106}_x$ are formed from any material that enables the working edges $\mathbf{138}_x$ of the planar members $\mathbf{106}_x$ to support sandpaper during a sanding operation with the power tool 10. Although the planar members $\mathbf{106}_x$ are shown as being substantially identical to one another, the planar members $\mathbf{106}_x$ in other embodiments have different geometries. For instance, in some embodiments, a thickness of the second planar member $\mathbf{106}_2$ between its upper $\mathbf{128}_2$ and lower $\mathbf{130}_2$ surfaces is greater than a thickness of the third planar member $\mathbf{106}_3$. In other embodiments, the working edges $\mathbf{138}_x$ of the planar members $\mathbf{106}_x$ have respective profiles that differ from one another when viewed in a plane perpendicular to the upper surfaces $\mathbf{128}_x$ of the planar members $\mathbf{106}_x$ and aligned along the longitudinal direction 142.

The clamping assembly 104 includes a clamp plate 146 and a clamp member 148, which in the illustrate embodiment is a screw. The clamp plate 146 is positioned adjacent to the upper surface $\mathbf{128}_x$ of the uppermost planar member $\mathbf{106}_x$, which in the embodiment of FIGS. 1-4, is the fourth planar member $\mathbf{106}_4$. The clamp plate 146 has an opening 150 through which the clamp member or screw 148 is inserted and passes through the respective elongated slots 140$_x$ of each of the planar members 106$_x$. The supporting portion 110 of the mounting plate 102 may have a threaded opening 152 into which the clamp screw 148 is engageable to secure the planar members 106$_x$ between the clamp plate 146 and the supporting portion 110. Alternatively, the clamp screw 148 may engage a threaded nut (not shown) or a nested screw (not shown) in a conventional manner. The clamp plate 146 in the embodiment shown covers a portion of the upper surface 128$_x$ of the fourth planar member 106$_4$. In other embodiments, the clamp plate 146 can cover more or less of the upper surface 128$_x$ of the uppermost planar member 106$_x$.

In one embodiment, the clamp plate 146 and the first 124 and second 126 lateral tabs are sized such that at least a portion of the first and second lateral tabs extends above the upper surface 128$_x$ of the uppermost planar member 106$_x$ and the clamp plate 146 is positionable between the first and second lateral tabs. The accessory 100 in some embodiments includes a kit that includes two or more clamp screws 148$_x$ that have different lengths to accommodate different numbers of stacked planar members 106$_x$ on the mounting plate 102. For instance, a first clamp screw 148$_1$ in one embodiment has a first length sized to secure four planar members 106$_x$ under the clamp plate 146 while a second clamp screw 148$_2$ has a second length that is longer than the first length to secure five planar members 106$_x$ under the clamp plate 146.

The clamp assembly 104 is adjustable between a released position in which the planar members 106$_x$ are each movable along the supporting portion 110 in the longitudinal direction 142 and a clamped position in which the planar members 106$_x$ are fixed in position on the supporting portion 110. With the clamp assembly 104 in the released position, the planar members 106$_x$ are each moveable relative to the supporting portion 110 such that the respective working edges 138$_x$ of the planar members 106$_x$ are positionable at different offsets from the forward edge portion 122 of the supporting portion 110. With the clamp assembly 104 in the clamped position, the respective working edges 138$_x$ of the planar members 106$_x$ are fixed relative to the forward edge portion 122 and to each other. In the embodiment illustrated in FIGS. 1-3, the clamp assembly 104 incorporates a threaded screw for fixing and clamping the plates together. Alternatively, the clamp assembly may incorporate some form of quick-release or cam mechanism to simply the clamping process.

The planar members 106$_x$ are shown in the figures with generally smooth upper and lower surfaces so that the planar members can slide freely in the longitudinal direction 142 relative to each other and to the mounting plate 102. Alternatively, the surfaces of the planar members may be provided with a surface feature that resists relative movement between planar members when the clamp assembly is in its clamped position. The surface feature is configured to allow the planar members to achieve essentially unlimited positions relative to each other or to achieve at least infinitesimal gradations of relative movement. In one example, each planar member 106$_x$ may be provided with a surface roughness coating on at least one surface of the member.

Figure 4:
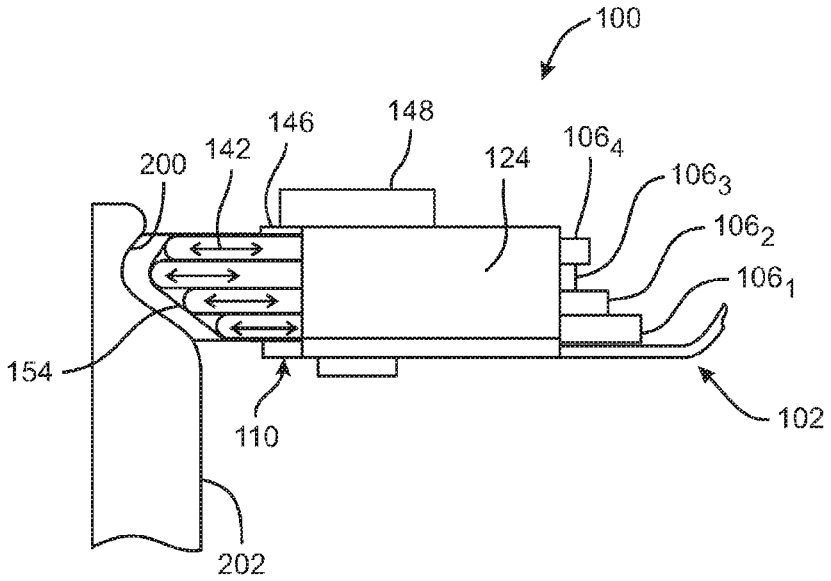
FIG. 4 shows a side schematic view of the adjustable contour sander attachment and the surface of FIG. 3.

A method for using the accessory 100 is discussed with reference to FIG. 3 and FIG. 4. A user identifies a contour 200 in a surface 202 to be sanded by the power tool 10. The user can select the number of planar members to be stacked on the mounting plate that is sufficient to complement the contour 200. A segment of sandpaper 154 can be affixed to the accessory 100 in a suitable manner, such as by fixing along the respective working edges 138$_x$ of the selected planar members 106$_x$. In some embodiments, the sandpaper 154 may be mechanically fastened to the accessory between the supporting portion 110 of the mounting plate 102 and the clamp assembly 104. The sandpaper 154 in other embodiments may include an adhesive backing that adheres to the working edges 138$_x$ and/or the surfaces of the planar members 106$_x$ or of the mounting plate supporting portion 110 and/or clamp plate 146. The sandpaper 146 may be further provided with an opening, similar to the opening 140 in the planar members, to receive the clamp screw 148 therethrough.

The clamp assembly 104 of the accessory 100 is then adjusted to the released position such that the planar members 106$_x$ are adjustable relative to the forward edge portion 122 of the mounting plate 102. With the clamp assembly 104 in the released position, the planar members 106$_x$ with the affixed sandpaper 154 are still restrained in the longitudinal direction 142 (by the screw 148 extending through the slots 140) so that the planar members and the sandpaper can be moved into contact with the contour 200 until the respective working edges 138$_x$ of the planar member 106$_x$ take the shape of the contour 200. It can be appreciated that the planar embers are sized in the longitudinal direction so that the working ends 138 all extend beyond the end 122 of the mounting plate. Moreover, the slots 140 in the planar members 106$_x$ have a length sufficient to allow the combined working edges of the stacked planar members to form a wide range of contour shapes and depths. In one embodiment, the slots 140 may have a length of about one inch.

Once the planar members 106$_x$ take the shape of the contour 200, the clamp assembly 104 is adjusted to the clamped position to fix the working edges 138$_x$ of the planar members 106$_x$ relative to the forward edge portion 122 of the mounting plate 102. The user then ensures that the sandpaper is snug against the working edges 138$_x$ of the planar members 106$_x$. The mounting portion 108 of the mounting plate 102 can be mounted onto the tool holder 36 of the power tool 10 so that the user can operate the power tool 10 to sand the contour 200 in the surface 202.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. An accessory for a power tool having a drive element capable of reciprocating or oscillatory motion, the accessory comprising:

a mounting plate including a mounting portion configured for engagement to the drive element of the power tool;

a support portion connected to the mounting plate, said support portion defining a support surface;

two or more planar members sized to be stacked on a support surface of the support portion of the mounting plate; and a clamp assembly for clamping the two or more planar members to the support portion, wherein:

said mounting portion is planar and defines a first plane; and said support portion is planar and defines a second plane offset from said first plane.

2. The accessory of claim 1, wherein:

said mounting plate defines a longitudinal direction from said mounting portion to said support portion;

said support portion includes opposite upturned tabs laterally offset from each other relative to the longitudinal direction to define a lateral space therebetween; and each of said two or more planar members has a width sized for a close running fit between said upturned tabs.

3. The accessory of claim 1, wherein:

said mounting plate defines a longitudinal direction from said mounting portion to said support portion;

said clamp assembly is movable from a released position in which said two or more planar members are capable of restrained sliding movement relative to each other in said longitudinal direction, and a clamped position in which the clamp assembly clamps the two or more planar members and said support portion of said mounting plate together.

4. The accessory of claim 3, wherein;

each of said two or more planar members defines an elongated opening aligned with the longitudinal direction when the planar members are stacked on said support portion; and said clamp assembly includes a clamp member configured to extend through said elongated opening of each of said two or more planar members stacked on said support portion, said clamp member engageable to said support portion.

5. The accessory of claim 4, wherein said clamp assembly includes a clamp plate and said clamp member is a screw extending through said clamp plate and said two or more planar members and engageable to said support portion.

6. The accessory of claim 5, wherein:

said mounting plate defines a longitudinal direction from said mounting portion to said support portion;

said support portion includes opposite upturned tabs laterally offset from each other relative to the longitudinal direction to define a lateral space therebetween; and said two or more planar members and said clamp plate have a width sized for a close running fit between said upturned tabs.

7. The accessory of claim 1, wherein:

said mounting plate defines a longitudinal direction from said mounting portion to said support portion; and each of said two or more planar members includes a working edge and said planar members are sized so that said working edge extends beyond the end of said support portion in said longitudinal direction when said planar members are stacked on and clamped on said support portion.

8. The accessory of claim 7, wherein said working edge of each of said planar members is arcuate.

9. The accessory of claim 1, wherein said two or more planar members have substantially the same thickness.

10. The accessory of claim 1, wherein said two or more planar members have different thicknesses relative to each other.

11. A method for preparing a power tool for sanding a contoured surface comprising:

stacking two or more planar members on a support portion of a mounting plate;

applying a clamp assembly to the planar members and mounting plate and initially positioning the clamp assembly in a released position in which the two or more planar members are free to slide relative to each other and to the support portion of the mounting plate relative to a longitudinal direction of the mounting plate;

with the clamp assembly in the released position, placing a working edge of the two or more planar members against the contour to be sanded and then placing the clamp assembly in the clamped position to clamp the stacked planar members to the support portion of the mounting plate; and fastening a mounting portion of the mounting plate, separate from the support portion, to the drive mechanism of the power tool.

12. The method of claim 11, wherein the mounting portion of the mounting plate includes upturned tabs on opposite sides of the mounting plate and the stacking step includes positioning the two or more planar members in a close running fit between the upturned tabs.

13. The accessory of claim 11, wherein the two or more planar members have substantially the same thickness.

14. The accessory of claim 11, wherein the two or more planar members have different thicknesses relative to each other.

15. The accessory of claim 11, wherein the working edge of each of the planar members is arcuate and the stacking step includes positioning the planar members with the working edge facing the contour to be sanded.

* * * * *